US005756040A

United States Patent [19]

Yabuki

[11] Patent Number: 5,756,040

[45] Date of Patent: May 26, 1998

[54] PROCESS OF MAKING POLYBENZAZOLE NONWOVEN FABRIC

[75] Inventor: Kazuyuki Yabuki, Ohtsu, Japan

[73] Assignee: Toyobo Co., Ltd., Osaka, Japan

[21] Appl. No.: 793,039

[22] PCT Filed: Aug. 2, 1995

[86] PCT No.: PCT/US95/09818

§ 371 Date: Jan. 30, 1997

§ 102(e) Date: Jan. 30, 1997

[87] PCT Pub. No.: WO96/04413

PCT Pub. Date: Feb. 15, 1996

[30] Foreign Application Priority Data

Aug. 3, 1994 [JP] Japan ..... 6-182420

[51] Int. Cl.[6] ..... D01D 5/06; D01F 6/26; D01F 6/74; D02G 3/02

[52] U.S. Cl. ..... 264/555; 264/103; 264/184; 264/210.8; 264/211.15; 264/211.16; 264/233

[58] Field of Search ..... 264/103, 184, 264/210.8, 211.15, 211.16, 233, 555

[56] References Cited

U.S. PATENT DOCUMENTS

| | | | |
|---|---|---|---|
| 5,164,131 | 11/1992 | Chau et al. | 264/28 |
| 5,288,445 | 2/1994 | Tani et al. | 264/85 |
| 5,288,452 | 2/1994 | Yabuki | 264/345 |
| 5,294,390 | 3/1994 | Rosenberg et al. | 264/103 |
| 5,296,185 | 3/1994 | Chau et al. | 264/205 |
| 5,356,584 | 10/1994 | Bubeck et al. | 264/205 |
| 5,385,702 | 1/1995 | Mills et al. | 264/103 |
| 5,393,478 | 2/1995 | Sen et al. | 264/203 |
| 5,411,694 | 5/1995 | Alexander et al. | 264/184 |
| 5,417,915 | 5/1995 | Chau et al. | 264/344 |
| 5,429,787 | 7/1995 | Im et al. | 264/344 |
| 5,525,638 | 6/1996 | Sen et al. | 521/61 |
| 5,534,205 | 7/1996 | Faley et al. | 264/103 |
| 5,552,221 | 9/1996 | So et al. | 428/373 |
| 5,585,052 | 12/1996 | Chau et al. | 264/28 |

FOREIGN PATENT DOCUMENTS

WO 94/12700 6/1994 WIPO .

*Primary Examiner*—Leo B. Tentoni
*Attorney, Agent, or Firm*—Morrison & Foerster LLP

[57] ABSTRACT

A continuous process for preparing nonwoven fabrics of polybenzazole filaments, which comprises spinning at least two polybenzazole dope filaments simultaneously, and intermingling and depositing the filaments on a substantially planar collecting surface, thereby forming a nonwoven fabric.

6 Claims, 2 Drawing Sheets

PROCESS OF MAKING POLYBENZAZOLE NONWOVEN FABRIC

BACKGROUND OF THE INVENTION

This invention relates to articles of polybenzazole polymer and, more specifically, to fabrics of polybenzazole fiber.

Nonwoven fabrics are known materials which comprise assemblies of textile fibers held together by mechanical interlocking in a random web or mat, by fusing of thermoplastic fibers, or by bonding the fibers with a cementing medium such as starch, glue, casein, rubber, latex, cellulose derivative, or synthetic resins. Polybenzazole fibers are known fibers which are prepared by extruding filaments of a polybenzazole dope, drawing the filaments across an air gap, combining the filament to form a multifilament structure, and then washing and drying the structure under conditions sufficient to remove the acid solvent and the water from the filament. An efficient process for the preparation of nonwoven fabrics of polybenzazole would be desirable.

SUMMARY OF THE INVENTION

Figure 1:
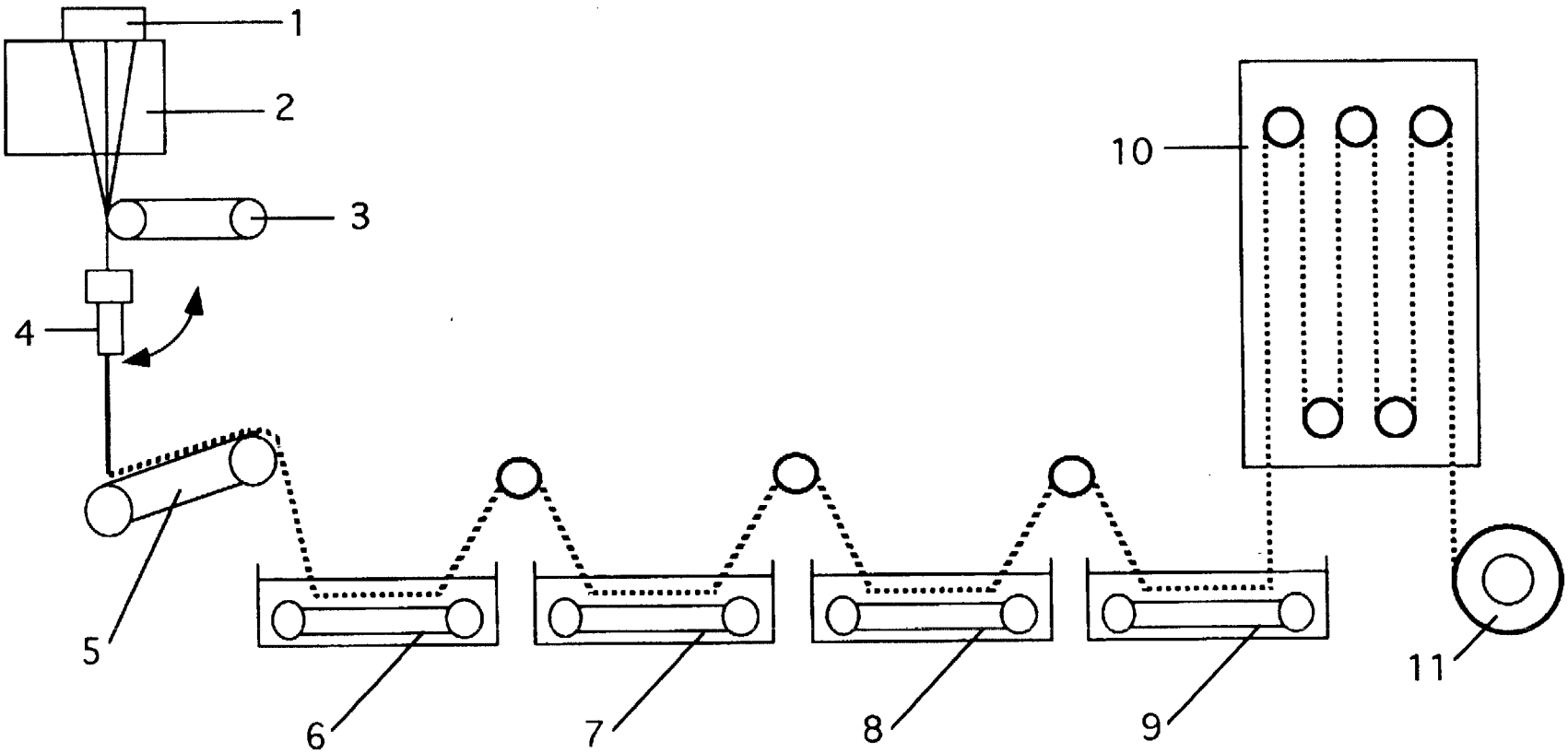
FIGS. 1 and 2 are schematic representations of two embodiments of the process of the invention.

In one aspect, this invention is a continuous process for preparing nonwoven fabrics of polybenzazole filaments, which comprises spinning at least two polybenzazole dope filaments simultaneously, and intermingling and depositing the filaments on a substantially planar collecting surface.

It has been discovered that the process of the invention provides a means of preparing nonwoven polybenzazole fabrics in a continuous, on-line process which permits the polybenzazole dope to be extruded at a very high speed, since the speed of the on-line process is not limited by the line speed which would be necessary to wash and dry single filaments in an on-line process. Further, since the fabric moves through the washing and drying equipment at a much slower rate of speed than a single fiber, fewer washing and drying cabinets may be required to effectively wash and dry the fabric. These and other advantages of the invention will be apparent from the description which follows.

In the process of the invention, two or more polybenzazole dope filaments are extruded onto a substantially planar collecting surface. The polybenzazole filaments used in the process of the invention may be obtained by spinning a dope containing a polybenzazole polymer. As used herein, "polybenzazole" refers to polybenzoxazole (PBO) homopolymers, polybenzothiazole (PBT) homopolymers, and random, sequential, or block copolymerized polymer of PBO and PBT. Polybenzoxazole, polybenzothiazole, and random, sequential, or block copolymerized polymers thereof are described, for example, in "Liquid Crystalline Polymer Compositions, Process and Products" by Wolfe et. al, U.S. Pat. No. 4,703,103 (Oct. 27, 1987); "Liquid Crystalline Polymer Compositions, Process and Products" U.S. Pat. No. 4,533,692 (Aug. 6, 1985); "Liquid Crystalline Poly(2,6-benzothiazole) Composition, Process and Products," U.S. Pat. No. 4,533,724 (Aug. 6, 1985); "Liquid Crystalline Polymer Compositions, Process and Products," U.S. Pat. No. 4,533,693 (Aug. 6, 1985); "Thermooxidatively Stable Articulated p-Benzobisoxazole and p-Benzobisthiazole Polymers" by Evers, U.S. Pat. No. 4,539,567 (Nov. 16, 1982); and "Method for Making Heterocyclic Block Copolymer" by Tsai, U.S. Pat. No. 4,578,432 (Mar. 25, 1986).

The structural units present in PBZ polymer are preferably selected so that the polymer is lyotropic liquid crystalline. Preferred monomer units are illustrated below in Formulae I-VIII. The polymer more preferably consists essentially of monomer units selected from those illustrated below, and most preferably consists essentially of cis-polybenzoxazole, trans-polybenzoxazole, or trans-polybenzothiazole.

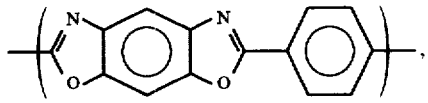

(I)

cis-polybenzoxazole

Poly[benzo(1,2-d:5,4-d')bisoxazole-2,6-diyl-1,4-phenylene]

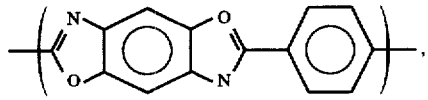

(II)

trans-polybenzoxazole

Poly[benzo(1,2-d:4,5-d')bisoxazole-2,6-diyl-1,4-phenylene]

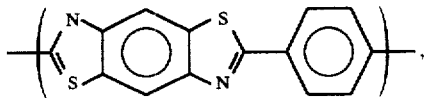

(III)

trans-polybenzothiazole

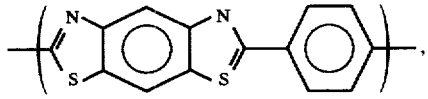

(IV)

cis-polybenzothiazole

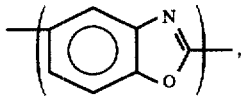

(V)

AB-PBO

Poly(2,5-benzoxazole)

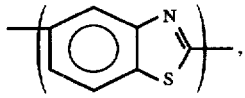

(VI)

Poly(2,5-benzothiazole)

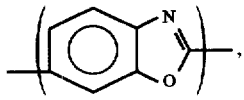

(VII)

AB-PBO

Poly(2,6-benzoxazole)

and

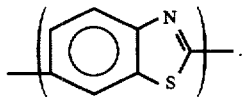

(VIII)

Poly(2,6-benzothiazole)

Suitable polybenzazole polymers or copolymers and dopes can be synthesized by known procedures, such as those described in Wolfe et al., U.S. Pat. No. 4,533,693 (Aug. 6, 1985); Sybert et al., U.S. Pat. No. 4,772,678 (Sep. 20, 1988); Harris, U.S. Pat. No. 4,847,350 (Jul. 11, 1989); and Gregory et al., U.S. Pat. No. 5,089,591 (Feb. 18, 1992). In summary, suitable monomers are reacted in a solution of non-oxidizing and dehydrating acid (the acid solvent) under non-oxidizing atmosphere with vigorous mixing and high shear at a temperature that is increased in step-wise or ramped fashion from no more than 120° C. to at least 190° C. Suitable solvents for the preparation of PBZ polymer dope include cresols and non-oxidizing acids. Examples of suitable acid solvents include polyphosphoric acid, methane sulfonic acid, and highly concentrated sulfuric acid or mixtures thereof. Preferably, the solvent acid is polyphosphoric acid or methane sulfonic acid, but is most preferably polyphosphoric acid.

The polymer concentration in the solvent is preferably at least 7 percent by weight, more preferably at least 10 percent by weight, and most preferably at least 13 percent by weight. The maximum concentration is limited by the practical factors of handling, such as polymer solubility and dope viscosity. The polymer concentration normally does not exceed 30 percent by weight, and is preferably no greater than about 20 percent by weight. Oxidation inhibitors, de-glossing agents, coloring agents, and anti-static agents may also be added to the dope.

The solutions of polybenzazole polymers may be stored for a period of time prior to spinning. However, it is particularly desirable to conduct a continuous polymerization, direct spinning method in which polymerization is conducted continuously and a spinning dope is supplied directly to a spinning device without prior storage. The process of the present invention is preferably run in a continuous fashion with a spinning speed of at least about 50 meters/minute (m/min). The spinning speed is more preferably at least about 200 m/min, more preferably at least about 400 m/min and most preferably at least about 600 m/min.

Due to the high extensional viscosity of most polybenzazole dopes, it is preferable to apply a drawing tension to the filament in order to efficiently extrude the dope. The draw tension is preferably at least about 1 gram/denier, more preferably at least about 3 grams/denier, but is preferably no greater than about 10 grams per denier, more preferably no greater than about 5 grams per denier. Since it is difficult to achieve this level of tension with an air or gas aspirator, the filaments are preferably drawn utilizing an aspirator which uses the flow of a liquid to reduce the air pressure in the aspirator (hereafter, "liquid aspirator"), and then deposited on the collecting device. Alternatively, a set of draw rolls positioned between the spin-die and the aspirator may be used to draw the filament, which then may be deposited on the collecting device utilizing either a gas or liquid aspirator. Preferably, the aspirator moves in a swinging motion relative to the collecting device, in order to more effectively and evenly scatter the fiber on the surface of the device.

After the filaments are extruded they are intermingled and deposited on a substantially planar collecting surface. The filaments may be intermingled by any suitable method, such as by passing the filaments through a device which utilizes an aspirator to create turbulence and draw or convey the filaments through it to the collecting surface.

If an aspirator device is utilized, the temperature of the aspirator gas or liquid may be increased above ambient conditions to soften the dope, if desired, which will cause the filaments in contact with each other to adhere. In such cases, when the filaments are subsequently washed and dried, the filaments will continue to adhere, creating a more rigid fabric than would be obtained otherwise. If a heated liquid is to be used in the aspirator, it is preferably a liquid which is not a solvent for the acid contained in the dope, so that the acid is not removed before the filament is deposited on the collecting surface. If the aspirator fluid is a solvent for the acid, such as water, a portion of the solvent may be removed as the filament passes through the aspirator and the dope filament will not adhere as effectively after being deposited on the collecting device. Examples of fluids which may be used which are not solvents for either the acid or polybenzazole polymer include alkylene glycols. The flow rate of the fluid through the aspirator is preferably at least about 20 m/sec.

The spun filament is deposited on a substantially planar collecting surface. The filament first passes through an aspirator or other device which may be used to direct the filament onto the substantially planar collecting surface. Although the collecting surface should be substantially flat and level enough to hold the extruded dope filaments, it may be made of a flexible material such as net conveyer but is not a godet or roll as is typically used in a fiber spinning process. Any solid material may be used to make the collecting surface, but is preferably one which is chemically resistant to the effect of the acid in the polybenzazole dope and any gases or liquids to which it may be exposed during the process.

The polybenzazole filaments are preferably deposited on the collecting device in amounts and under conditions sufficient to form a random network having an average width of at least about 1 cm. However, it is more efficient from a processing standpoint to prepare a random network having a much greater width, such as at least about 0.2 m, so that a correspondingly wider nonwoven fabric will be obtained.

After the filament is deposited on the collecting device, it may be washed and dried using methods which are typically employed in the manufacture of polybenzazole fibers. The filaments are preferably washed to remove at about 80 percent of the solvent acid present in the dope, more preferably at least about 90 percent, and most preferably at least about 95 percent. Examples of suitable washing fluids include water, methanol, and aqueous solutions of the solvent acid. If the solvent acid is polyphosphoric acid, the filaments are preferably washed to a residual phosphorous content of less than about 8,000 ppm, more preferably less than about 5,000 ppm. The filaments are preferably dried to a moisture content of less than 3.0 percent by weight, more preferably less than 2.0 percent by weight, more preferably less than 1.0 percent by weight, and most preferably less than 0.5 percent by weight, and any suitable drying device may be employed. If desired, the filament may also be heat-treated to improve its tensile modulus as described, for example, in U.S. Pat. No. 5,288,442.

Figure 2:
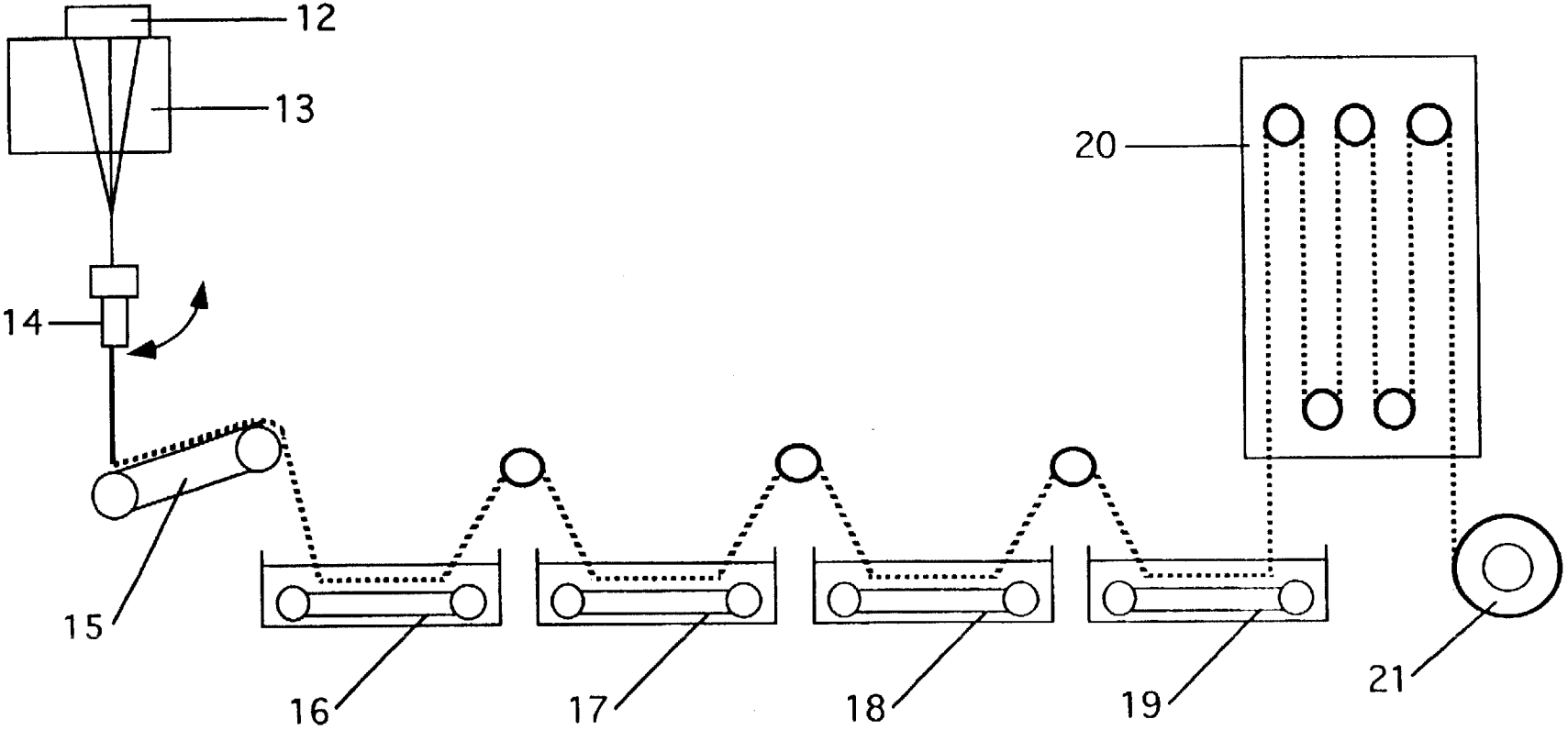

Referring now to FIG. 1, an apparatus is shown having a spinning head (1) which is spinning filaments through a quench chamber (2), over a pair of polytetrafluoroethylene-coated godet rolls (3), through a compressed air aspirator (4), and onto a net conveyor (5) on which the filaments are collected. The filaments then pass through a series of washing baths (6), (7), and (9), and a neutralization bath (8). The washed filaments then pass through a dryer (10) and the resulting nonwoven fabric is wound on a winding roll (11). Referring to FIG. 2, an apparatus is shown having a spinning head (12) which is spinning filaments through a quench chamber (13), through a water flow aspirator (14), and onto a net conveyor (15) on which the filaments are collected. The filaments then pass through a series of washing baths (16), (17), and (19), and a neutralization bath (18). The washed filaments then pass through a dryer (20) and the resulting nonwoven fabric is wound on a winding roll (21).

The nonwoven fabric obtained by washing and drying the filaments which have been processed according to the invention, is a random web or mat of polybenzazole filaments. As the filaments are deposited on the collecting device at a high rate of speed, they will become intermingled. They may also become intermingled as they pass through the aspirator. The intermingling causes the filaments to become mechanically interlocked, and the filaments will remain intermingled as they are washed and dried. The drawing and intermingling process may cause the filaments to break periodically before or as they are deposited, although such breakage will not significantly affect the process. After the fabric is washed and dried, the mechanical interlocking of the filaments may be increased further, if desired, by use of a needle punch, water punch, or calender device designed for such purpose. If the dope filaments are deposited at a temperature at which the dope is soft, such as above about 80° C., the filaments will tend to adhere to each other, even after the filaments are washed and dried, which will also act to hold the fabric together. In addition, a binder may also be applied to the fabric after it has been washed and dried, if desired.

The polybenzazole nonwoven fabric prepared by the washing and drying of the filaments according to the process of the invention has advantageous heat resistance, tearing power, tear strength, insulating, wear resistance, and flame resistance properties. The tensile strength of the filaments is preferably at least about 25 g/d, and the tensile modulus is preferably at least about 700 g/d. If the fabric is heat-treated at a temperature of at least about 350° C., the tensile modulus of the filaments may increase to greater than 1500 g/d.

EXAMPLES

The following examples are given to illustrate the invention and should not be interpreted as limiting it in any way. Unless stated otherwise, all parts and percentages are given by weight.

Example 1

A solution of polybenzoxazole in polyphosphoric acid was prepared from 4,6-diamino-1,3-benzenediol.dihydrochloride and terephthalic acid. The dope had a phosphorous pentoxide content of 83.17 percent and an intrinsic viscosity of 24.4 dL/g, as measured in methane sulfonic acid at 30° C., and was prepared using the method described in U.S. Pat. No. 4,533,693. The dope was passed through a metal screen filter and degassed in a twin screw extruder. The pressure was raised, and the dope was transferred to a spinning head using a metering pump and heated to 170° C. The dope was spun through a spinneret with 334 orifices at 170° C., and then cooled to 60° C. in a quench chamber. The filaments were drawn over a pair of driven godet rolls having a surface treated with polytetrafluoroethylene, at a speed of 200 m/min. The filaments were then drawn through an aspirator through which compressed air was fed, and deposited on a net conveyor moving at a speed of 20 cm/min. The network of filaments was then washed in a 10 percent aqueous solution of polyphosphoric acid maintained at a temperature of 22°±2° C. The filaments were then subsequently washed in a water bath, and then immersed in a 0.1N sodium hydroxide solution to be neutralized. The filaments were then washed in a water bath, and dried for 5 minutes at 190° C. The resulting nonwoven fabric had a weight of 55 g/m$^2$ and a water content of 0.8 percent. Twenty single filaments were removed from the fabric to determine their average physical properties, which are as follows: 1.5 denier filament, 35 g/denier (g/d) tensile strength, 800 g/d tensile modulus, 4.5 percent elongation.

Example 2

Polybenzoxazole filaments were prepared using the procedure described in Example 1 except that the temperature of the quench chamber is 80° C. The extruded filaments were drawn using a water aspirator, and then deposited on a net conveyor. The filaments were then washed, dried, and neutralized using the procedure described in Example 1. Twenty single filaments were removed from the fabric to determine their average physical properties, which are as follows: 2.5 denier filament, 33 g/denier (g/d) tensile strength, 800 g/d tensile modulus, 4.4 percent elongation.

What is claimed is:

1. A continuous process for preparing nonwoven fabrics of polybenzazole filaments, which comprises spinning at least two polybenzazole dope filaments simultaneously, and intermingling and depositing the filaments on a substantially planar collecting surface, thereby forming a nonwoven fabric.

2. The process of claim 1 wherein the polybenzazole is polybenzoxazole.

3. The process of claim 1 wherein the polybenzazole is polybenzothiazole.

4. The process of claim 1 wherein the process comprises the additional steps of washing and drying the deposited filament.

5. The process of claim 1 wherein the spun filament is drawn with a liquid aspirator prior to being deposited on the collecting surface.

6. The process of claim 1 wherein the spun filament is drawn with a pair of driven godet rolls prior to being deposited on the collecting surface.

* * * * *